US007710352B2

(12) United States Patent
Jung et al.

(10) Patent No.: US 7,710,352 B2
(45) Date of Patent: May 4, 2010

(54) PLASMA DISPLAY PANEL COMPRISING ENERGY RECOVERY CIRCUIT AND DRIVING METHOD THEREOF

(75) Inventors: Yun Kwon Jung, Gumi-si (KR); Soong Kyu Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 916 days.

(21) Appl. No.: 11/339,800

(22) Filed: Jan. 26, 2006

(65) Prior Publication Data

US 2006/0164373 A1 Jul. 27, 2006

(30) Foreign Application Priority Data

Jan. 27, 2005 (KR) ..... 10-2005-0007755

(51) Int. Cl.
*G09G 3/28* (2006.01)

(52) U.S. Cl. ..... 345/60; 345/66

(58) Field of Classification Search ..... 345/60–69, 345/211, 204; 315/169.1–169.4
See application file for complete search history.

(56) References Cited

U.S. PATENT DOCUMENTS 5,642,018 A 6/1997 Marcotte
6,466,186 B1 10/2002 Shimizu
2003/0102812 A1 6/2003 Marcotte
2005/0007310 A1 1/2005 Kim

FOREIGN PATENT DOCUMENTS

CN 1773588 A 5/2006
KR 10-2001-0097045 A 11/2001
KR 2001-0097045 * 11/2001
KR 10-2004-0103993 A 12/2004

OTHER PUBLICATIONS

Chinese Office Action dated May 9, 2008.
Chinese Office Action dated Jan. 19, 2009.
European Search Report dated Apr. 1, 2009.

* cited by examiner

*Primary Examiner*—Regina Liang
(74) *Attorney, Agent, or Firm*—KED & Associates, LLP

(57) ABSTRACT

A plasma display panel comprising an energy recovery circuit and a driving method thereof are provided. The plasma display panel comprises an energy charging part for supplying a predetermined voltage, an energy supply and recovery part for receiving an energy of the predetermined voltage from the energy charging part, and a pulse forming part. The pulse forming part supplies the energy of the predetermined voltage supplied from the energy supply and recovery part to the plasma display panel, maintains a sustain voltage of the plasma display panel, and recovers the energy of the predetermined voltage to the energy supply and recovery part.

15 Claims, 7 Drawing Sheets

PLASMA DISPLAY PANEL COMPRISING ENERGY RECOVERY CIRCUIT AND DRIVING METHOD THEREOF

This Non-provisional application claims priority under 35 U.S.C. § 119(a) on Patent Application No. 10-2005-0007755 filed in Korea on Jan. 27, 2005, the entire contents of which are hereby incorporated by reference.

BACKGROUND OF THE INVENTION

1. Field of the Invention

The present invention relates to a plasma display panel comprising an energy recovery circuit and a driving method thereof, and more particularly, to a plasma display panel capable of removing a peak voltage of a scan electrode and a driving method thereof.

2. Description of the Background Art

In a general plasma display panel, ultraviolet rays of 147 nm emitted by discharging a He—Xe gas mixture or a Ne—Xe gas mixture excite phosphors. Images of characters or graphics are displayed on the plasma display panel by the excited phosphors.

FIG. 1 shows a structure of a related art plasma display panel.

As shown in FIG. 1, a plasma display panel 30 comprises a scan electrode 12A and a sustain electrode 12B formed on a front substrate 10 and a data electrode 20 formed on a rear substrate 18.

The scan electrode 12A and the sustain electrode 12B each comprise a transparent electrode and a bus electrode. The transparent electrode is formed of indium-tin-oxide (ITO) and the bus electrode is formed of a metal capable of reducing a resistance of the transparent electrode.

An upper dielectric layer 14 and a protective layer 16 are stacked on the front substrate 10 on which the scan electrode 12A and the sustain electrode 12B are formed.

Wall charges generated by a plasma discharge of the plasma display panel 30 are accumulated on the upper dielectric layer 14. The protective layer 16 prevents a damage of the upper dielectric layer 14 caused by sputtering generated by the plasma discharge, and also increases a secondary electron emission coefficient. The protective layer 16 is generally formed of MgO.

A lower dielectric layer 22 and a barrier rib 24 are formed on the rear substrate 18 on which the data electrode 20 is formed. A phosphor layer 26 is coated on the surfaces of the lower dielectric layer 22 and the barrier rib 24.

The data electrode 20 is formed to intersect the scan electrode 12A and the sustain electrode 12B. The barrier rib 24 is formed in parallel with the data electrode 20. The barrier rib 24 prevents the ultraviolet rays and visible light emitted by the plasma discharge from being radiated to adjacent discharge cells.

The ultraviolet rays generated by the plasma discharge excite the phosphor layer 26 to generate any one of red, green or blue light. A He—Xe gas mixture or a Ne—Xe gas mixture is injected into a discharge space of the discharge cell between the front and rear substrates 10 and 18 and the barrier rib 24.

FIG. 2 shows a driving waveform of a related art plasma display panel.

As shown in FIG. 2, the related art plasma display panel is driven by dividing each of a plurality of subfields into a reset period for initializing the whole screen, an address period for selecting cells to be discharged, a sustain period for maintaining discharges of the selected cells, and an erase period for erasing wall charges in the discharged cells.

In the reset period, a rising pulse Ramp-up is simultaneously applied to all scan electrodes Y during a set-up period SU to generate a dark discharge within discharge cells of the whole screen. By the discharge performed during the set-up period SU, positive wall charges are accumulated on address electrodes X and sustain electrodes Z, while negative wall charges are accumulated on the scan electrodes Y.

A falling pulse Ramp-down is applied to the discharge cells during a set-down period SD. The falling pulse Ramp-down which falls from a positive voltage less than a peak voltage of the rising pulse Ramp-up to a ground voltage or a certain negative voltage partially removes wall charges excessively formed in the cells. As a result, wall charges required for performing a stable address discharge uniformly remains in the cells.

In the address period, a scan pulse Sp is sequentially applied to the scan electrodes Y and at the same time, a data pulse Dp is applied to the address electrodes X in synchronous with the scan pulse Sp. A data voltage Vd of the data pulse Dp is commonly 65 V.

While the voltage difference between the scan pulse Sp and the data pulse Dp is added to the wall charges produced during the reset period, the address discharge is generated within the discharge cells to which the data pulse Dp is applied. Wall charges required for a sustain discharge generated by supplying a sustain voltage Vs are formed within the cells selected by the address discharge.

A bias voltage Zdc is supplied to the sustain electrodes Z during the set-down period SD and the address period to decrease the voltage difference between the sustain electrodes Z and the scan electrodes Y. Accordingly, the supply of the bias voltage Zdc prevents misdischarge between the sustain electrodes Z and the scan electrodes Y.

In the sustain period, a sustain pulse SUSp is alternately applied to the scan electrodes Y and the sustain electrodes Z. While the wall voltages within the cells selected by the address discharge are added to the sustain pulse SUSp, a sustain discharge, that is, a display discharge is generated between the scan electrodes Y and the sustain electrodes Z whenever the sustain pulse SUSp is applied.

In the erase period, after completing the sustain discharge, an erase pulse Ramp-ers having a narrow pulse width and a low voltage is supplied to the sustain electrodes Z to remove the wall charges remaining in the cells of the whole screen.

FIG. 3 is a related art energy recovery circuit diagram of the plasma display panel.

As shown in FIG. 3, when the plasma display panel is driven according to the driving waveform of FIG. 2, the sustain pulse SUSp is formed by an energy recovery circuit. When the plasma display panel is normally driven, charges corresponding to 0.5 Vs are charged to a capacitor C of the energy recovery circuit. When a first switch Q1 is turned on in a charged state of the capacitor C, a voltage of the scan electrode Y rises up to a sustain voltage Vs by LC resonance between the plasma display panel and an inductor L. When a second switch Q2 is turned on, a voltage of the scan electrode Y is maintained with the sustain voltage Vs. When a third switch Q3 is turned on, a voltage of the scan electrode Y falls to a ground voltage GND by LC resonance between the plasma display panel and the inductor L. Afterwards, when a fourth switch Q4 is turned on, a voltage of the scan electrode Y is maintained with the ground voltage GND.

FIG. 4 shows a voltage waveform of the scan electrode shown according to an operation of the energy recovery circuit of FIG. 3 when initially driving the plasma display panel.

As shown in FIG. 4, when the plasma display panel is initially driven by the supply of a power supply, charges corresponding to 0.5 Vs are not charged to the capacitor C of the energy recovery circuit. Afterwards, the charges corresponding to 0.5 Vs are charged to the capacitor C by continuously performing turn-on and turn-off operations of the first to fourth switches Q1 to Q4 in order.

In a period indicated by a reference numeral ① of FIG. 4, when the first switch Q1 is turned on in a state that the charges corresponding to 0.5 Vs are not charged to the capacitor C, a voltage of the scan electrode Y rises up to a voltage less than the sustain voltage Vs.

Next, in a period indicated by a reference numeral ② of FIG. 4, when the second switch Q2 is turned on, the sustain voltage Vs is applied to the scan electrode Y. Here, since the voltage difference between the sustain voltage and the voltage of the scan electrode Y is large, a large current flows to the energy recovery circuit. As a result, a peak voltage of the scan electrode Y is generated. When the peak voltage generated in the scan electrode Y is larger than a breakdown voltage of the switches or diodes constituting the energy recovery circuit, problems in normal operations of the switches or the diodes are generated.

SUMMARY OF THE INVENTION

Accordingly, an object of the present invention is to solve at least the problems and disadvantages of the related art.

The present invention provides a plasma display panel capable of removing a peak voltage generated in a scan electrode by more rapidly charging a capacitor of an energy recovery circuit when initially driving a plasma display panel, and a driving method thereof.

According to an aspect of the present invention, there is provided a plasma display panel comprising an energy charging part for supplying a predetermined voltage, an energy supply and recovery part for receiving an energy of the predetermined voltage from the energy charging part, and a pulse forming part for supplying the energy of the predetermined voltage supplied from the energy supply and recovery part to the plasma display panel, for maintaining a sustain voltage of the plasma display panel and for recovering the energy of the predetermined voltage to the energy supply and recovery part.

It is preferable that the predetermined voltage equals a voltage corresponding to a voltage of a data pulse.

It is preferable that an address voltage supply part generates the predetermined voltage.

It is preferable that when initially driving the plasma display panel, a voltage of a scan electrode increases substantially to two times the predetermined voltage.

It is preferable that the energy charging part comprises a diode for preventing an inverse current.

It is preferable that the energy charging part comprises a resistor which is connected in series between the diode and an energy charging power supply source.

It is preferable that the energy supply and recovery part comprises a capacitor.

According to another aspect of the present invention, there is provided a method of driving a plasma display panel comprising supplying a predetermined voltage to an energy supply and recovery part, supplying an energy of the predetermined voltage charged to the energy supply and recovery part to the plasma display panel, maintaining a sustain voltage of the plasma display panel, and recovering the energy of the predetermined voltage to the energy supply and recovery part.

It is preferable that the predetermined voltage equals a voltage corresponding to a voltage of a data pulse.

It is preferable that an address voltage supply part generates the predetermined voltage.

It is preferable that a voltage of a scan electrode increases substantially to two times the predetermined voltage when initially driving the plasma display panel.

It is preferable that the predetermined voltage is supplied through a diode for preventing an inverse current.

It is preferable that the predetermined voltage is supplied through a resistor which is connected in series between the diode and an energy charging power supply source.

It is preferable that the energy supply and recovery part comprises a capacitor.

According to still another aspect of the present invention, there is provided a plasma display panel comprising an address voltage supply part for supplying an address voltage, an energy supply and recovery part for receiving an energy of the address voltage from the address voltage supply part, and a pulse forming part for supplying the energy of the address voltage supplied from the energy supply and recovery part to the plasma display panel, for maintaining a sustain voltage of the plasma display panel, and for recovering the energy of the address voltage to the energy supply and recovery part.

It is preferable that the address voltage equals a voltage corresponding to a voltage of a data pulse.

It is preferable that when initially driving the plasma display panel, a voltage of a scan electrode increases substantially to two times the address voltage.

It is preferable that the address voltage supply part comprises a diode for preventing an inverse current.

It is preferable that the address voltage supply part comprises a resistor which is connected in series between the diode and an address voltage supply source.

It is preferable that the energy supply and recovery part comprises a capacitor.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Reference will now be made in detail to embodiments of the present invention, examples of which are illustrated in the accompanying drawings.

Hereinafter, exemplary embodiments of the present invention will be described in detail with reference to the attached drawings.

Figure 1:
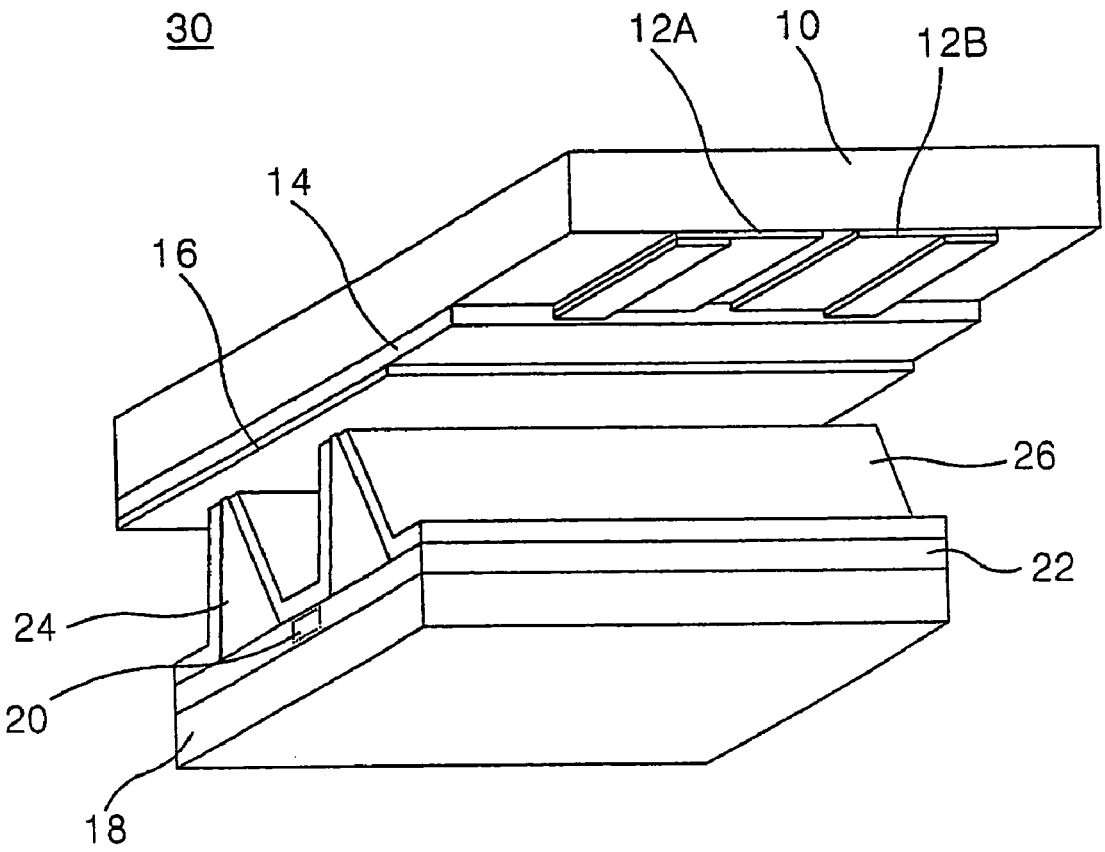
FIG. 1 Related ART
FIG. 1 shows a structure of a related art plasma display panel.
Figure 2:
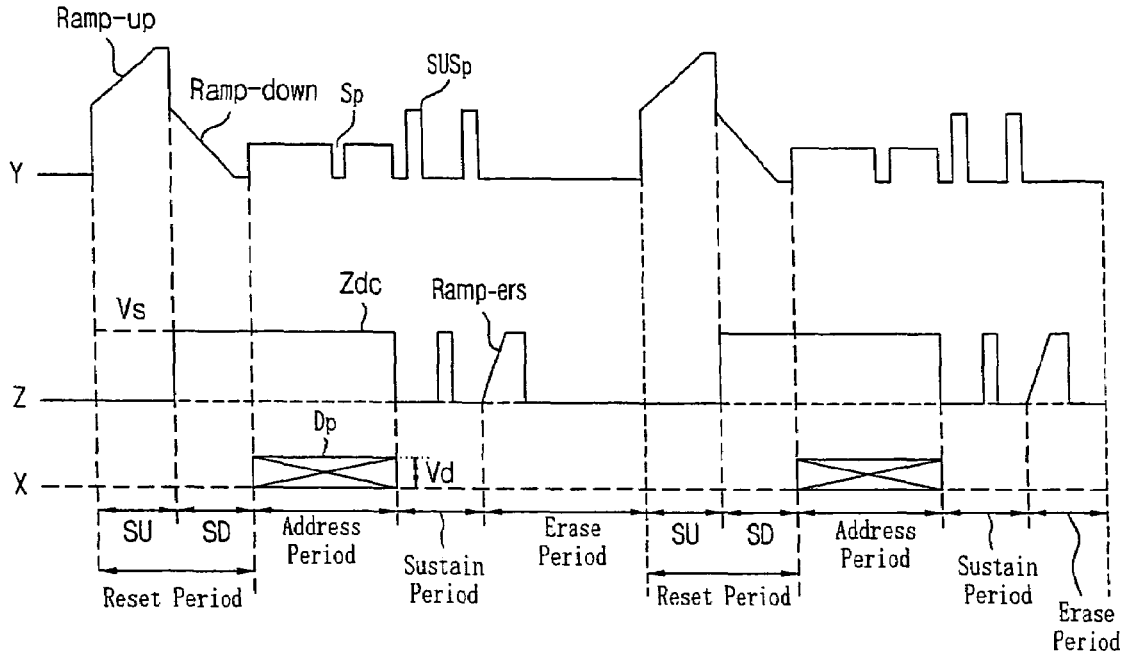
FIG. 2 Related ART
FIG. 2 shows a driving waveform of a related art plasma display panel.
Figure 3:
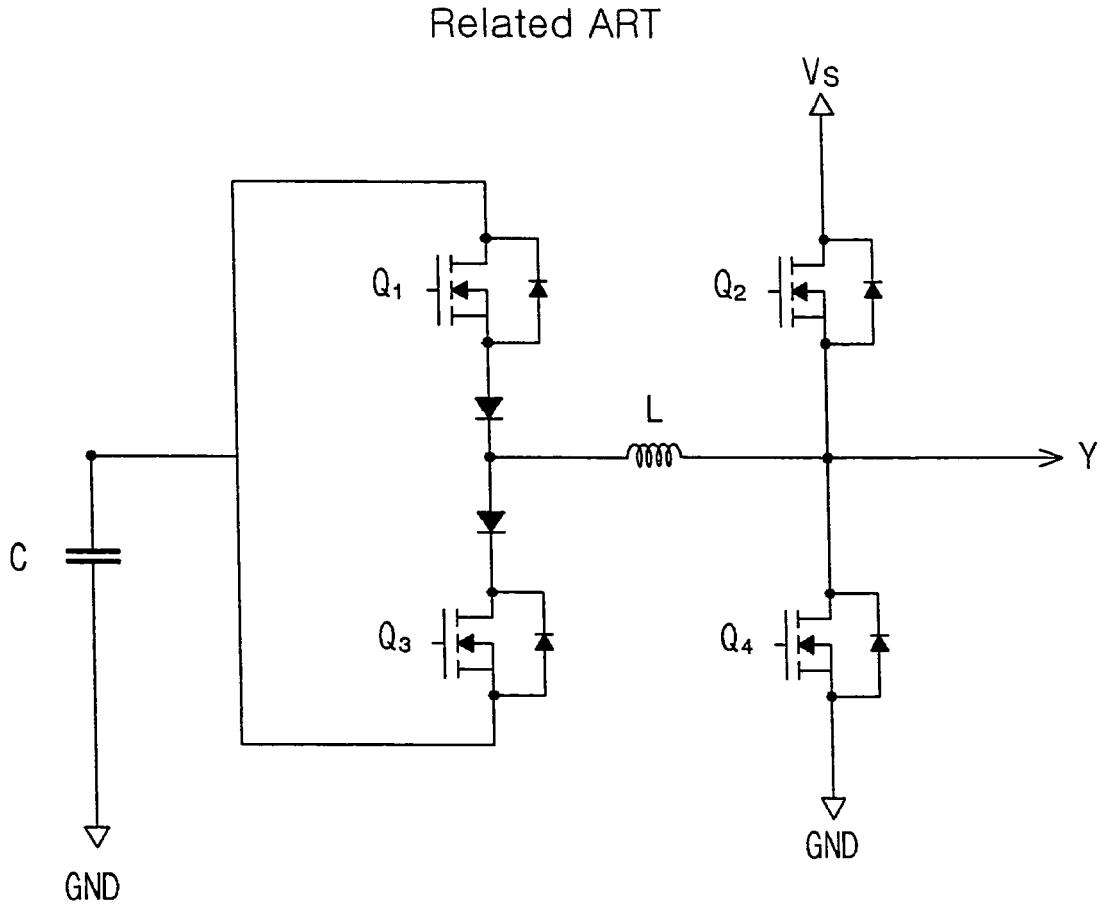
FIG. 3 shows a related art energy recovery circuit diagram of the plasma display panel.
Figure 4:
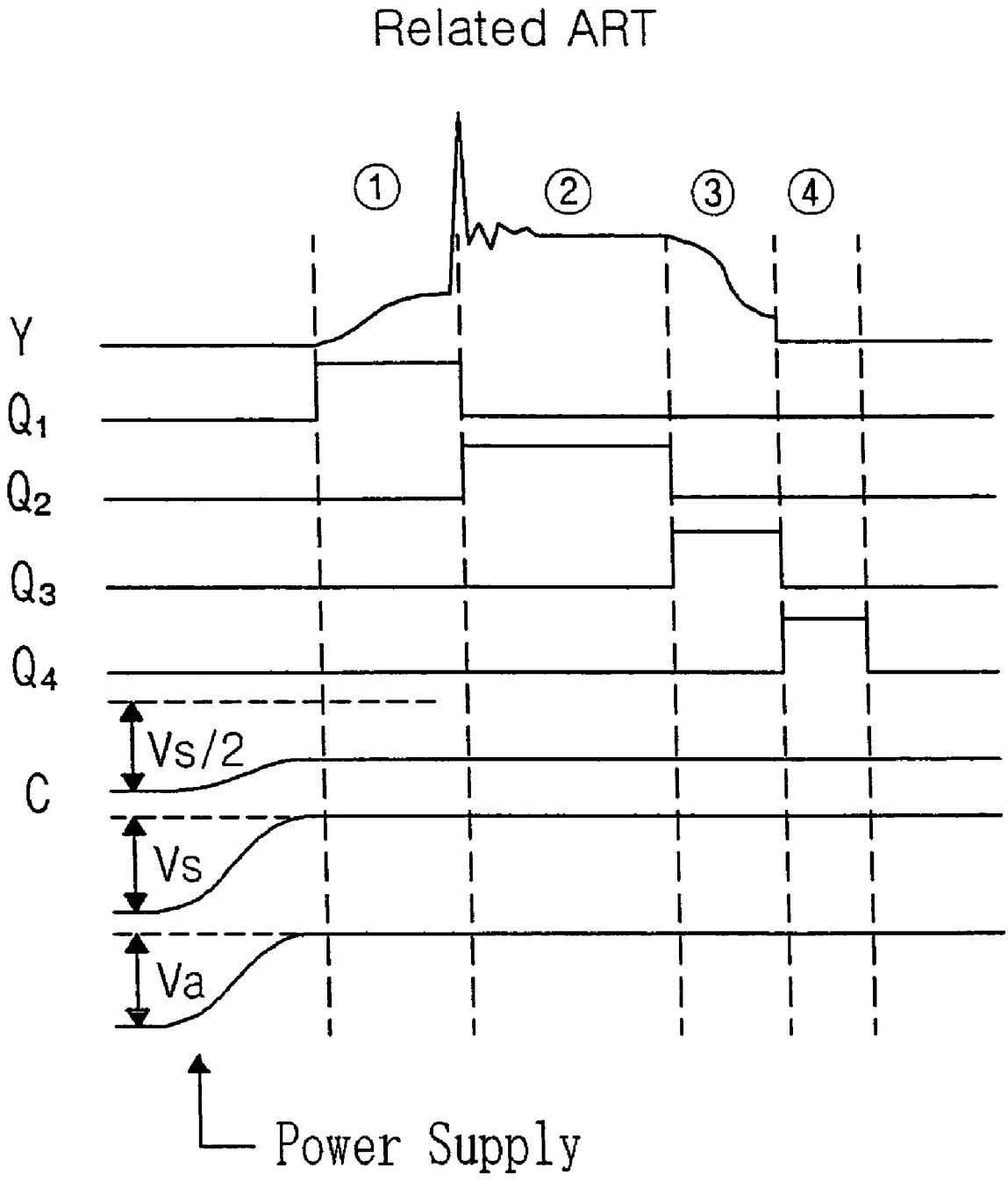
FIG. 4 shows a voltage waveform of the scan electrode showing according to an operation of the energy recovery circuit of FIG. 3 when initially driving the plasma display panel.
Figure 5:
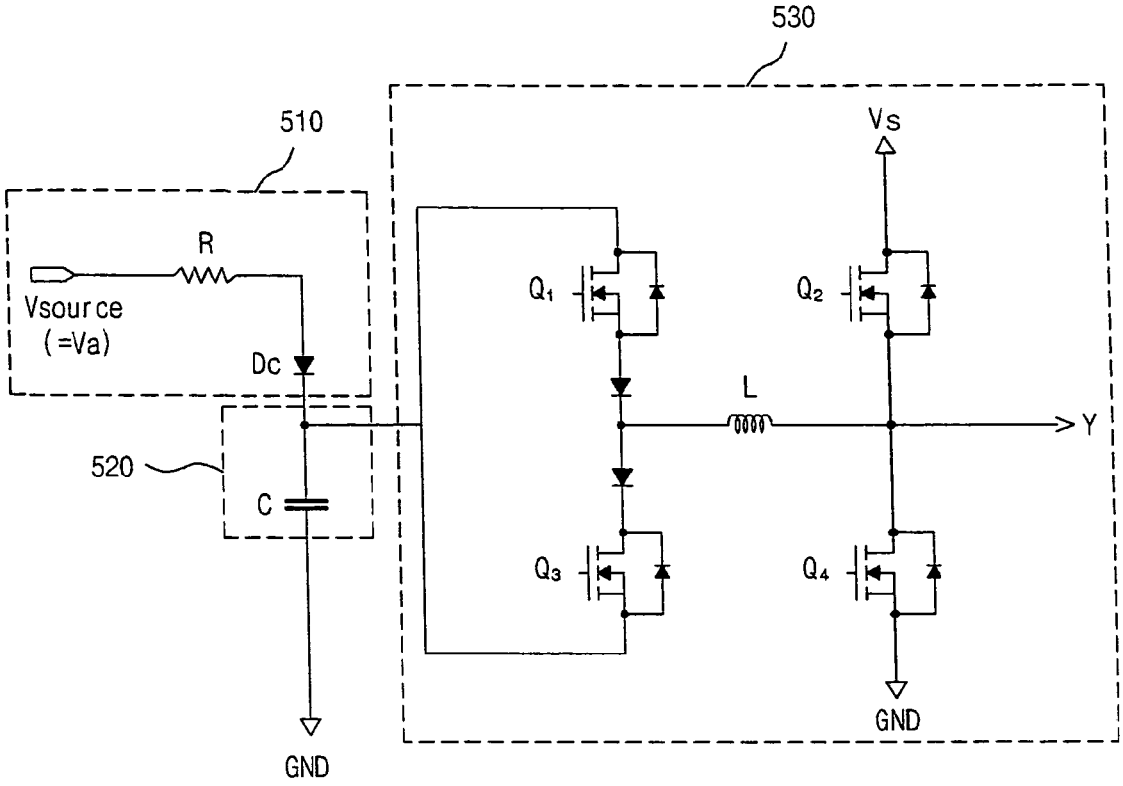
FIG. 5 shows an energy recovery circuit diagram of a plasma display panel according to an embodiment of the present invention.

FIG. 5 shows an energy recovery circuit diagram of a plasma display panel according to an embodiment of the present invention.

As shown in FIG. 5, an energy recovery circuit diagram of a plasma display panel according to an embodiment of the present invention comprises an energy charging part 510, an energy supply and recovery part 520 and a pulse forming part 530.

When the plasma display panel is initially driven by the supply of a power supply, the energy charging part 510 supplies a predetermined voltage supplied from an energy charge power supply source Vsource to the energy supply and recovery part 520. The predetermined voltage may equal a voltage Va corresponding to a voltage of a data pulse.

Since a sustain voltage Vs ranges from 180V to 200 V and the voltage Va of the data pulse ranges from 60V to 65 V, an address voltage supply part can be used as a voltage supply source for supplying the closest voltage to a voltage of 0.5 Vs. Since the predetermined voltage supplied from the energy charging part 510 equals the voltage Va corresponding to the voltage of the data pulse, it is unnecessary to add a separate power supply source.

When the plasma display panel is initially driven, the energy charging part 510 supplies an energy of the predetermined voltage to the energy supply and recovery part 520.

The pulse forming part 530 supplies the energy of the predetermined voltage supplied from the energy supply and recovery part 520 to the plasma display panel through resonance between an inductor L and the plasma display panel. A voltage of the panel is maintained with the sustain voltage Vs. Then, the energy of the supplied predetermined voltage is recovered to the energy supply and recovery part 520 through the resonance between the inductor L and the panel.

When a voltage of the energy supply and recovery part 520 is more than the predetermined voltage, a reverse-blocking diode Dc included in the energy charging part 510 prevents an inverse current. A cathode end of the reverse-blocking diode Dc is connected to the energy supply and recovery part 520 and an anode end is connected to the energy charge power supply source Vsource. A resistor R may be connected between the energy charge power supply source Vsource and the reverse-blocking diode Dc. The resistor R prevents a rapid increase in a voltage.

When the plasma display panel is initially driven, a voltage of a scan electrode Y (refer to FIG. 6) increases substantially to two times the predetermined voltage. The energy supply and recovery part 520 comprises a capacitor.

Figure 6:
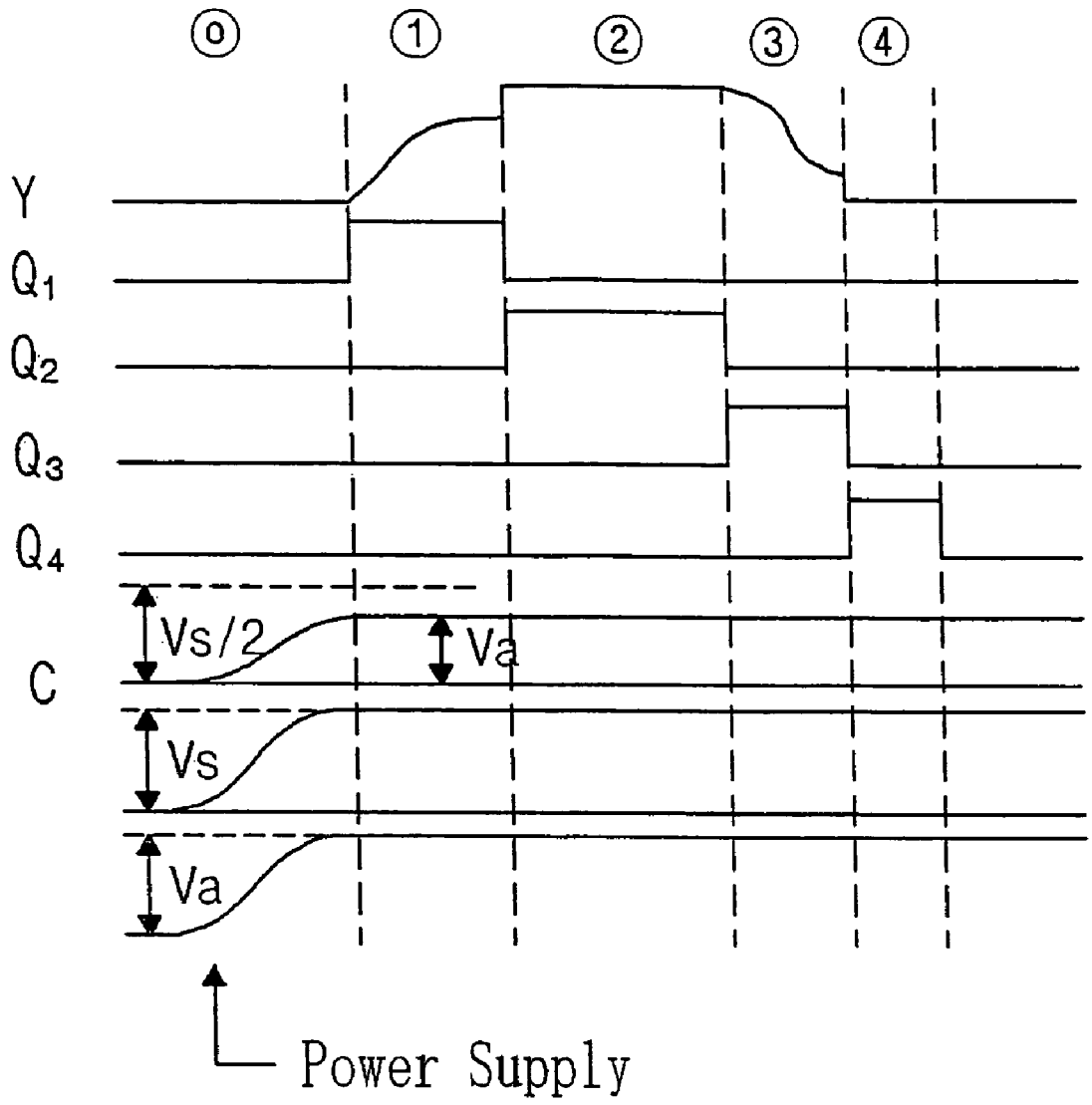
FIG. 6 shows a switch timing chart of the energy recovery circuit of FIG. 5 and a voltage of a scan electrode according to the switch timing.

FIG. 6 shows a switch timing chart of the energy recovery circuit of FIG. 5 and a voltage of a scan electrode according to the switch timing.

As shown in FIG. 6, when the power supply is supplied to the plasma display panel, the sustain voltage Vs and the voltage Va of the data pulse are supplied in a period indicated by a reference numeral ◎ of FIG. 6. As a result, the energy charge power supply source Vsource supplies the predetermined voltage (corresponding to the voltage Va of the data pulse) to the capacitor C of the energy supply and recovery part 520. Then, the energy supply and recovery part 520 is charged to an energy of the predetermined voltage (Va).

In a period indicated by a reference numeral ① of FIG. 6, when the first switch Q1 is turned on, the energy of the predetermined voltage supplied to the energy supply and recovery part 520 is supplied to the plasma display panel. Moreover, a voltage of the scan electrode Y increases to two times the predetermined voltage (=2Va) by the resonance between the inductor L and the panel.

Next, in a period indicated by a reference numeral ② of FIG. 6, when the second switch Q2 is turned on, the voltage of the scan electrode Y increases to the sustain voltage Vs. Since the voltage of the scan electrode Y increases from the voltage of 2Va to the sustain voltage Vs, a change in the voltages of the scan electrode Y is less than a change in the voltages of the scan electrode Y in the related art energy recovery circuit.

In the energy recovery circuit according to the embodiment of the present invention, when the plasma display panel is initially driven, a voltage of the capacitor C of the energy supply and recovery part 520 is Va in the period ◎ and the voltage of the scan electrode Y is 2Va in the period ①. In other words, since, a change in the voltages of the scan electrode Y is relatively small in the period ②, the peak voltage of the scan electrode Y is low.

Since the likelihood of an abnormal operation of the switches or the diode decreases due to the low peak voltage of the scan electrode Y, the reliability of the energy recovery circuit increases.

Next, when a third switch Q3 is turned on in the period ③, the energy of the predetermined voltage supplied to the plasma display panel is recovered to the energy supply and recovery part 520 by the resonance between the inductor L and the panel. Moreover, the voltage of the scan electrode Y falls to the ground voltage.

When a fourth switch Q4 is turned on in a period ④, the voltage of the scan electrode Y is maintained with the ground voltage.

Accordingly, since when the plasma display panel is initially driven, the capacitor of the energy recovery circuit is charged more rapidly to remove the peak voltage of the scan electrode Y, the plasma display panel can be driven stably.

Figure 7:
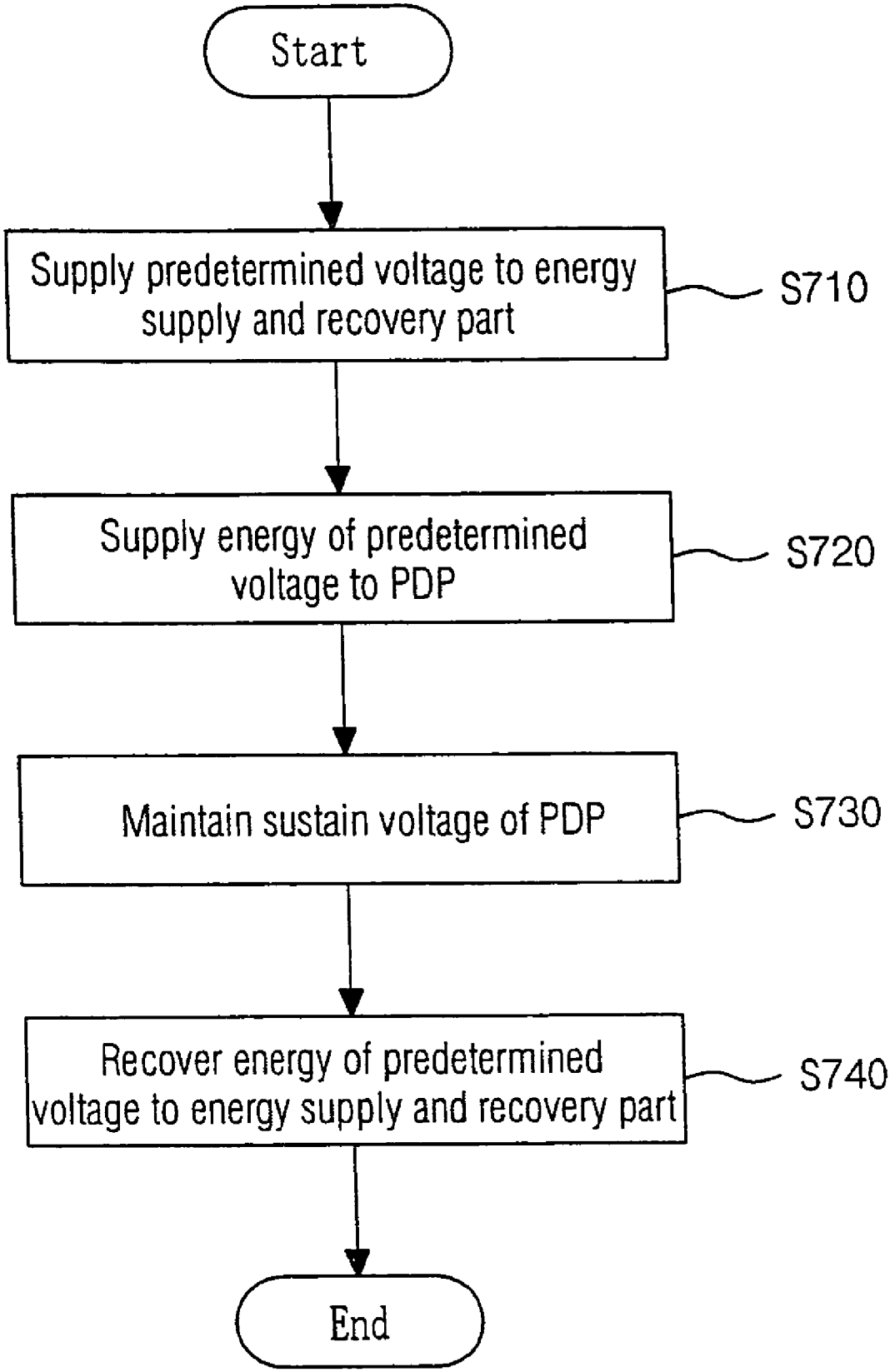
FIG. 7 is a flow chart showing a driving method of the plasma display panel according to the embodiment of the present invention.

FIG. 7 is a flow chart showing a driving method of the plasma display panel according to the embodiment of the present invention.

As shown in FIG. 7, the energy charging part 510 supplies the predetermined voltage supplied from the energy charge power supply source Vsource to the energy supply and recovery part 520 in S710. The predetermined voltage may equal the voltage Va corresponding to the voltage of the data pulse. An address voltage supply part may be used as a power supply source of the voltage Va.

The pulse forming part 530 supplies an energy of the predetermined voltage supplied from the energy supply and recovery part 520 to the plasma display panel through resonance between an inductor L and the panel in S720. A voltage of the panel is maintained with the sustain voltage Vs in S730. Then, the energy of the supplied predetermined voltage is recovered to the energy supply and recovery part 520 through the resonance between the inductor L and the panel in S740.

When the voltage of the energy supply and recovery part 520 is more than the predetermined voltage, the reverse-blocking diode Dc included in the energy charging part 510 prevents an inverse current. The cathode end of the reverse-blocking diode Dc is connected to the energy supply and recovery part 520 and the anode end is connected to the energy charge power supply source Vsource. The resistor R may be connected between the energy charge power supply source Vsource and the reverse-blocking diode Dc.

When the plasma display panel is initially driven, the voltage of the scan electrode Y increases substantially to two times the predetermined voltage. The energy supply and recovery part 520 comprises the capacitor.

As described above, since when a plasma display panel according to the embodiment of the present invention is initially driven, an energy charging part supplies a predetermined voltage to an energy supply and recovery part, a peak voltage of a scan electrode can be removed. Moreover, abnormal operations of switches or diodes of an energy recovery circuit can be prevented. As a result, reliability of the energy recovery circuit increases.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

an address electrode;

an address voltage supply part for supplying a data pulse to the address electrode;

an energy charging part coupled to the address voltage supply part to receive an energy of a predetermined voltage therefrom;

an energy supply and recovery part for receiving an energy from the energy charging part; and a pulse forming part for supplying the energy of the predetermined voltage supplied from the energy supply and recovery part to the plasma display panel, for maintaining a sustain voltage of the plasma display panel, and for recovering the energy of the predetermined voltage to the energy supply and recovery part, wherein the predetermined voltage is equal to a peak voltage of the data pulse.

2. The plasma display panel of claim 1, wherein a voltage of a scan electrode increases substantially to two times the predetermined voltage when initially driving the plasma display panel.

3. The plasma display panel of claim 1, wherein the energy charging part comprises a diode for preventing an inverse current.

4. The plasma display panel of claim 3, wherein the energy charging part further comprises a resistor that is connected in series between the diode and an energy charging power supply source.

5. The plasma display panel of claim 1, wherein the energy supply and recovery part comprises a capacitor.

6. A method of driving a plasma display panel, comprising:

supplying a predetermined voltage to an energy supply and recovery part;

supplying an energy of the predetermined voltage stored in the energy supply and recovery part to the plasma display panel;

maintaining a sustain voltage of the plasma display panel; and recovering the energy of the predetermined voltage to the energy supply and recovery part, wherein the predetermined voltage is equal to a peak voltage of a data pulse applied to an address electrode of the plasma display panel, and wherein the energy of the predetermined voltage and the data pulse are supplied by an address voltage supply part.

7. The method of claim 6, wherein a voltage of a scan electrode increases substantially to two times the predetermined voltage when initially driving the plasma display panel.

8. The method of claim 6, wherein the predetermined voltage is supplied through a diode for preventing an inverse current.

9. The method of claim 8, wherein the predetermined voltage is supplied through a resistor that is connected in series between the diode and an energy charging power supply source.

10. The method of claim 6, wherein the energy supply and recovery part comprises a capacitor.

11. A plasma display panel, comprising:

an address electrode;

an address voltage supply part for supplying an address voltage;

an energy supply and recovery part for receiving an energy of the address voltage from the address voltage supply part; and a pulse forming part for supplying the energy of the address voltage supplied from the energy supply and recovery part to the plasma display panel, for maintaining a sustain voltage of the plasma display panel, and for recovering the energy of the address voltage to the energy supply and recovery part, wherein the address voltage is equal to a peak voltage of a data pulse applied to the address electrode of the plasma display panel.

12. The plasma display panel of claim 11, wherein a voltage of a scan electrode increases substantially to two times the address voltage when initially driving the plasma display panel.

13. The plasma display panel of claim 11, wherein the address voltage supply part comprises a diode for preventing an inverse current.

14. The plasma display panel of claim 13, wherein the address voltage supply part further comprises a resistor that is connected in series between the diode and an address voltage supply source.

15. The plasma display panel of claim 11, wherein the energy supply and recovery part comprises a capacitor.

* * * * *